US008080148B2

(12) United States Patent
Piesslinger-Schweiger et al.

(10) Patent No.: US 8,080,148 B2
(45) Date of Patent: Dec. 20, 2011

(54) ELECTROPOLISHING PROCESS FOR COBALT AND COBALT ALLOYS

(75) Inventors: Siegfried Piesslinger-Schweiger, Vaterstetten (DE); Olaf Böhme, Erding (DE)

(73) Assignee: Poligrat GmbH, Munich (DE)

( * ) Notice: Subject to any disclaimer, the term of this patent is extended or adjusted under 35 U.S.C. 154(b) by 1121 days.

(21) Appl. No.: 11/860,093

(22) Filed: Sep. 24, 2007

(65) Prior Publication Data

US 2008/0289970 A1 Nov. 27, 2008

(30) Foreign Application Priority Data

Sep. 25, 2006 (DE) ..... 10 2006 045 221

(51) Int. Cl.
*C25F 3/00* (2006.01)

(52) U.S. Cl. ..... 205/676; 205/674

(58) Field of Classification Search ..... 205/674, 205/676

See application file for complete search history.

(56) References Cited

U.S. PATENT DOCUMENTS 2,378,002 A * 6/1945 Drummond et al. ..... 204/206
6,679,980 B1 1/2004 Andreacchi
2003/0178320 A1 * 9/2003 Liu et al. ..... 205/640
2004/0154931 A1 * 8/2004 Hongo et al. ..... 205/676

FOREIGN PATENT DOCUMENTS

AT E 54186 B 12/1991
DE 10 2004045 297 A1 3/2006
JP 56152999 A 11/1981

OTHER PUBLICATIONS

Surmann et al., "Automatisierter Entwurf von Fuzzy Systemen", VDI Verlag, Reihe 8, Nr. 452, pp. 51-55.

* cited by examiner

*Primary Examiner* — Alexa D. Neckel
*Assistant Examiner* — Nicholas A. Smith
(74) *Attorney, Agent, or Firm* — Gail Silver; Borden Ladner Gervais LLP

(57) ABSTRACT

The present invention relates to a method of electrochemical polishing of surfaces of cobalt or cobalt alloys. It employs an electrolyte comprising glycolic acid and at least one alkane-sulfonic acid with an alkyl residue that has 1 to 3 carbon atoms. This electrolyte is also one aspect of the present invention. In one embodiment, at least one alkane-sulfonic acid comprises methane-sulfonic acid. The electrolyte and the method using this electrolyte are suitable in particular for surfaces of cobalt or cobalt alloys, including cobalt-chromium alloys such as stellite.

14 Claims, No Drawings

ELECTROPOLISHING PROCESS FOR COBALT AND COBALT ALLOYS

The present invention relates to a method of electrochemical polishing of surfaces of cobalt or cobalt alloys, and an electrolyte for the electrochemical polishing of such surfaces. Said electrolyte comprises glycolic acid and at least one alkane-sulfonic acid.

Workpieces that consist of cobalt or cobalt alloys, or have surfaces of cobalt or cobalt alloys, are becoming increasingly important. Thus, owing to their high resistance to corrosion and wear, cobalt alloys are finding application in various areas. The fields of application range over such diverse areas as the construction of machines and plants, where cobalt alloys are used for protection against wear, and medical engineering, where cobalt alloys are used for implants on account of their high corrosion resistance, their strength and the absence of nickel.

However, an appreciable obstacle to the use of cobalt-containing workpieces is the difficulty of smoothing and deburring their surfaces. This is because of the hard and very resistant carbides that are present in cobalt and cobalt alloys. Mechanical polishing of such surfaces is expensive and often produces stresses in the surface structure of the workpiece, which can have an adverse effect on the corrosion resistance of the workpieces.

Electrochemical polishing of such surfaces is one alternative. U.S. Pat. No. 6,679,980 B1 describes an electropolishing process that can be used for the electropolishing of stents, which can consist of cobalt-chromium-tungsten. The electrolyte used contains concentrated hydrochloric acid and concentrated sulfuric acid. An electrolyte containing sulfuric acid and hydrochloric acid, and additionally glycol, is also described in "Automatisierter Entwurf von Fuzzy Systemen", H. Surmann, VDI Verlag, Series 8, No. 452. The methods described in these documents concentrate primarily on special equipment and control systems of the electropolishing process. This is not surprising, because with the electrolytes described there, under conventional electropolishing conditions smoothing or deburring of the surfaces to the desired quality is often impossible. This too can be attributed to the carbides contained in the structure of the workpieces, as they are not removed to the same extent as the metal or the metal alloy and thus can sometimes even lead to an increase in surface roughness.

Electrolytes of perchloric acid and acetic acid that are described in the literature also often fail to provide satisfactory results. Furthermore, the perchloric acid used in these processes is explosive and it supports combustion, so that the use of these electrolytes containing perchloric acid is associated with risks and with costs connected with avoidance of said risks.

As already mentioned, cobalt alloys are becoming increasingly important especially in the field of medical engineering. One of the reasons for this is that an increasing proportion of the population suffers from allergies to nickel. Accordingly great efforts are being made to limit the use of nickel-containing special steels for medical implants. In addition to titanium, in particular cobalt-chromium alloys (so-called implant alloys) are considered as a replacement. However, for the implants to have sufficient corrosion resistance and biocompatibility, the surfaces of these workpieces require high-quality polishing. For the conventionally used chromium-nickel steels this is mainly achieved by electrochemical polishing, as this process gives the best results. So far, however, no comparably suitable electropolishing processes are available for cobalt-chromium alloys.

Cobalt-based hard metals are also often used in machine and plant construction, as their hardness and high wear resistance are far superior to those of other materials. For example, in nuclear power plants the surfaces of pumps, valves, bearings and other components that are particularly liable to wear are often armored with the cobalt alloy stellite. However, mechanical polishing of stellite often produces stresses, which have an adverse effect on the corrosion resistance of the workpieces. Subsequent heat treatment of the surfaces to relieve these stresses is expensive, however, and often because of the nature of the machine parts cannot be carried out to the required extent. Owing to these shortcomings, there has long been a need for electropolishing processes that enable the smoothing and deburring of surfaces of workpieces of cobalt or cobalt alloys to be performed with comparable quality as can be achieved in the electropolishing of surfaces of special steels.

DETAILED DESCRIPTION OF THE INVENTION

The present invention relates to a novel electrolyte, which makes possible the production of shiny, smooth and deburred surfaces of cobalt or cobalt alloys. This electrolyte comprises at least one alkane-sulfonic acid with an alkyl residue having 1, 2 or 3 carbon atoms, and glycolic acid. In one embodiment at least one alkane-sulfonic acid comprises methane-sulfonic acid. Such an electrolyte can comprise for example glycolic acid, methane-sulfonic acid and water.

That an electrolyte comprising a mixture of alkane-sulfonic acid (or several alkane-sulfonic acids), having an alkyl residue with 1 to 3 carbon atoms, and glycolic acid is capable of smoothing cobalt-based surfaces to an extent not previously achieved was completely surprising and unexpected. With this mixture as electrolyte, the electropolishing of cobalt and cobalt alloys, including alloys such as stellite, is possible without any notable attack of the grain boundaries. With said electropolishing process it is possible to obtain surfaces of cobalt-containing workpieces routinely of a quality with respect to gloss and smoothness not previously achieved. With this process it is possible to remove irregularities as well as stressed and damaged layers of material, and obtain cobalt-containing workpieces with a high-quality polished, stress-free surface. These surfaces also have substantially higher corrosion resistance than surfaces that have been polished mechanically, or have been electropolished with an electrolyte according to the state of the art.

In a preferred embodiment, the electrolyte according to the invention has a ratio of alkane-sulfonic acid to glycolic acid in the range from 30:70 to 80:20, based on the pure substances. A mixture with a ratio of alkane-sulfonic acid to glycolic acid in the range from 60:40 to 70:30, based on the pure substances, is further preferred. These amounts relate, like all other amounts, relative proportions and percentages stated in the present application, to the weight of the respective substances, components and solutions unless stated otherwise.

In a further preferred embodiment, the active substances alkane-sulfonic acid and glycolic acid are present in the electrolyte at high concentration. Thus, in one embodiment the electrolyte contains at most 35 wt. % water. Preferably the electrolyte contains at most 25 wt. % water.

In the preparation of the electrolyte according to the present invention it is therefore preferred to use the active substances either as pure substance or as concentrated solutions. Thus, the glycolic acid is used suitably as concentrated aqueous solution with 60-80 wt. % glycolic acid, preferably ≧70 wt. %. Such solutions are available commercially. However, it is also possible to use the pure substance, or self-generated solutions of glycolic acid in water.

Moreover, the alkane-sulfonic acid or alkane-sulfonic acids are preferably used in highly concentrated form. For example, methane-sulfonic acid can be used as approx. 85% or as ≧99% solution, which is commercially available.

In a preferred embodiment, the electrolyte according to the invention does not contain any explosive substances, in particular it does not contain perchloric acid or salts of perchloric acid.

A further aspect of the invention relates to methods of electrochemical polishing of cobalt-containing surfaces using the electrolyte described previously. These electropolishing processes according to the invention are suitable for the production of high-quality, microsmooth surfaces of workpieces of cobalt or cobalt alloys.

Said method can be carried out under all conditions that are customary in this field and are known to a person skilled in the art. Process temperatures in the range from 40° C. to 70° C. have proved to be especially suitable. Temperature control and monitoring can be performed in any manner known to a person skilled in the art. In a preferred embodiment, the method is carried out at an anodic current density between 5 and 25 A/dm$^2$. In a further embodiment of the invention, the anodic current density is around 10 A/dm$^2$.

The duration of the electropolishing process naturally depends on the roughness of the workpiece to be polished and the desired smoothing. The optimal time of action can be determined by a person skilled in the art within the scope of routine experiments in relation to the current density, temperature, composition of the electrolyte and of the electropolishing equipment used in routine experiments.

Following the electropolishing, the treated workpiece is removed from the polishing bath and usually rinsed with demineralized water, and dried if necessary.

The methods according to the invention are also especially suitable for the electrochemical polishing of workpieces with a surface comprising a cobalt-chromium alloy. These cobalt-chromium alloys can contain other constituents as well as the elements cobalt and chromium. These workpieces with surfaces of cobalt-chromium alloys, smoothed and deburred by methods according to the present invention, can be used as medical implants on account of their high level of compatibility with human tissue or biological tissue in general.

The cobalt-chromium alloy stellite, which comprises about 50-60% cobalt, 30-40% chromium and 8-20% tungsten, but can also contain smaller amounts of other elements, can also be smoothed and deburred with the methods described here with a quality not previously seen. The electropolishing processes described here for workpieces of cobalt alloys, for instance of stellite, can in particular also be used in nuclear engineering both in the production of new components prior to their use, and for the cleaning and decontamination of cobalt-containing components that are already in use or have been in use, to permit safer repair or disposal of these components. Furthermore, the electropolishing process according to the invention is also suitable for the production of high-quality smooth anti-wear coatings based on cobalt or cobalt alloy, which are applied to workpieces made of other materials.

The invention is explained in more detail in the following examples. These examples only represent possible embodiments of the electropolishing process described here and should not in any way imply a restriction to the conditions used here.

EXAMPLES

Electropolishing was carried out on the following:
implants made of a cobalt-chromium-molybdenum alloy,
tools made of a cobalt-chromium-tungsten alloy,
tools made of massive stellite, and
tools made of stainless steel with welded-on armor.

They were processed at a current density of 10 A/dm$^2$ and temperatures between 40° C. and 70° C. in an electrolyte comprising a mixture of ≧99% methane-sulfonic acid and ≧70% glycolic acid (in water) in a mixture ratio of 55:45. This corresponds to a ratio of the pure substances of about 65:35 and a water content of less than 15%.

The results showed, for all workpieces, high-gloss, smooth surfaces without observing selective attack at the grain boundaries.

What is claimed is:

1. An electrolyte consisting of at least one alkane-sulfonic acid with an alkyl residue having 1, 2 or 3 carbon atoms, water, and glycolic acid, for the electropolishing of surfaces of cobalt or cobalt alloys.

2. The electrolyte as claimed in claim 1, wherein the at least one alkane-sulfonic acid comprises methane-sulfonic acid.

3. The electrolyte as claimed in claim 1, wherein the ratio of alkane-sulfonic acid to glycolic acid is in the range from 30:70 to 80:20, based on the weight of the pure substances.

4. The electrolyte as claimed in claim 1, wherein the ratio of alkane-sulfonic acid to glycolic acid is in the range from 60:40 to 70:30, based on the weight of the pure substances.

5. The electrolyte as claimed in claim 1, wherein the electrolyte contains at most 35 wt. % water.

6. The electrolyte as claimed in claim 1, wherein the electrolyte contains at most 25 wt. % water.

7. The electrolyte as claimed in claim 1, wherein the electrolyte does not contain perchloric acid or perchlorates.

8. A method of electropolishing of surfaces of cobalt or cobalt alloys with an electrolyte as claimed in claim 1.

9. The method as claimed in claim 8, wherein the method is carried out at a temperature between 40° C. and 70° C.

10. The method as claimed in claim 8, wherein the method is carried out at an anodic current density from 5 to 25 A/dm$^2$.

11. The method as claimed in claim 8, wherein the method is carried out at an anodic current density of about 10 A/dm$^2$.

12. The method as claimed in claim 8, wherein the surface comprises a cobalt-chromium alloy.

13. The method as claimed in claim 12, wherein the surface is a surface of a medical implant.

14. The method as claimed in claim 12, wherein the cobalt-chromium alloy is stellite.

* * * * *